US006523603B2

(12) United States Patent
Uchikawa et al.

(10) Patent No.: US 6,523,603 B2
(45) Date of Patent: Feb. 25, 2003

(54) DOUBLE HEAT EXCHANGER WITH CONDENSER AND RADIATOR

(75) Inventors: Akira Uchikawa, Nagoya (JP); Shinobu Suzuki, Kariya (JP); Satomi Muto, Nishikasugai-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/940,135

(22) Filed: Aug. 27, 2001

(65) Prior Publication Data

US 2002/0023735 A1 Feb. 28, 2002

(30) Foreign Application Priority Data

Aug. 30, 2000 (JP) ..... 2000-261094
Nov. 30, 2000 (JP) ..... 2000-365510

(51) Int. Cl.[7] ..... F28F 9/02
(52) U.S. Cl. ..... 165/81; 165/149; 165/135
(58) Field of Search ..... 165/81, 135, 140, 165/149

(56) References Cited

U.S. PATENT DOCUMENTS 1,357,597 A * 11/1920 Springer ..... 165/149
2,933,291 A * 4/1960 Huggins ..... 165/149
3,939,908 A * 2/1976 Chartet ..... 165/149
3,960,210 A * 6/1976 Chartet ..... 165/149
4,041,594 A * 8/1977 Chartet ..... 165/151
5,992,514 A * 11/1999 Sugimoto et al. ..... 165/135
6,276,445 B1 * 8/2001 Sasano et al. ..... 165/135

FOREIGN PATENT DOCUMENTS

JP A-8-178556 7/1996
JP 10103893 A * 4/1998 ..... F28F/9/26

* cited by examiner

*Primary Examiner*—Allen Flanigan
(74) *Attorney, Agent, or Firm*—Harness, Dickey & Pierce, PLC

(57) ABSTRACT

In a double heat exchanger with a condenser and a radiator, a flexible portion formed into a wave shape to be flexible is provided in a side plate at least at one side of connection portions of the side plate, connected to condenser header tanks and radiator header tanks. Further, a slit is provided to be recessed from one longitudinal end of the side plate to the flexible portion. Accordingly, a heat stress generated in condenser tubes and radiator tubes can be absorbed by the flexible portion even when a length of the slit is made shorter.

8 Claims, 10 Drawing Sheets

DOUBLE HEAT EXCHANGER WITH CONDENSER AND RADIATOR

CROSS-REFERENCE TO RELATED APPLICATION

This application is related to and claims priority from Japanese Patent Applications No. 2000-261094 filed on Aug. 30, 2000, and No. 2000-365510 filed on Nov. 30, 2000, the contents of which are hereby incorporated by reference.

BACKGROUND OF THE INVENTION

1. Field of the Invention

The present invention relates to a double heat exchanger having several heat-exchanging portions such as a condenser and a radiator, in which different fluids having different temperatures flow, respectively.

2. Description of Related Art

In a conventional double heat exchanger described in JP-A-8-178556, a first heat exchanger and a second heat exchanger are connected by side plates to be integrated with each other. Further, for reducing heat stress generated in tubes of both the heat exchangers, a recess extending from one longitudinal end toward the other longitudinal end of the side plate is provided. However, in this double heat exchanger, the recess extending in the longitudinal direction of the side plate is need to be elongated enough for sufficiently reducing the heat stress generated in the tubes. Accordingly, strength of the side plates is reduced, and a performance for holding and fixing both the heat exchangers is deteriorated.

SUMMARY OF THE INVENTION

In view of the foregoing problems, it is an object of the present invention to provide a double heat exchanger which can reduces heat stress generated in tubes while preventing strength of a side plate from being reduced.

According to an aspect of the present invention, in a double heat exchanger having a first core and a second core, a side plate is disposed at one side of the first and second cores to extend in a direction parallel with first and second tubes of the first and second cores for reinforcing the first and second cores, and the side plate is disposed to be connected to both first header tanks and both second header tanks at connection portions. The side plate has a flexible portion disposed to be flexible at least at one side of the connection portions, and a recess extending from one longitudinal end of the side plate until the flexible portion in a longitudinal direction of the side plate to separate the side plate at the one side of the connection portions. Accordingly, even when heat expansion amount is different in the first tubes of the first core and the second tubes of the second core, heat stress generated in the tubes can be absorbed by the deformation of the flexible portion. Further, because the recess extends from the one longitudinal end of the side plate until the flexible portion in the longitudinal direction of the side plate, the recess can be made shorter. Thus, in the double heat exchanger, the heat stress generated in the tubes can be reduced while it can prevent the strength of the side plate from being reducing.

According to an another aspect of the present invention, in a double heat exchanger with a first core and a second core, a side plate is disposed at one side of the first and second cores to extend in a direction parallel with first and second tubes of the first and second cores to be connected to both first header tanks and both second header tanks at connection portions, the side plate has a recess portion extending from one end in a direction crossing with the longitudinal direction of the side plate at least at one side of the connection portions, and the recess portion has a recess top part curved by a curvature radius larger than a predetermined dimension. Accordingly, even when a heat expansion amount in the second tubes is different from that in the first tubes, heat stress generated in the tubes can be absorbed by changing an opening area of the recess portion. Further, because the recess top part is curved by the curvature radius larger than the predetermined dimension, it can prevent the stress from being collected at the top end of recess portion. Therefore, it can prevent a crack from being caused at the top end of the recess portion. Thus, a durability of the side plate can be improved while the heat stress generated in the first and second tubes can be absorbed. Preferably, the curvature radius is equal to or larger than a thickness of the side plate. In this case, the durability of the side plate can be further improved.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Figure 1:
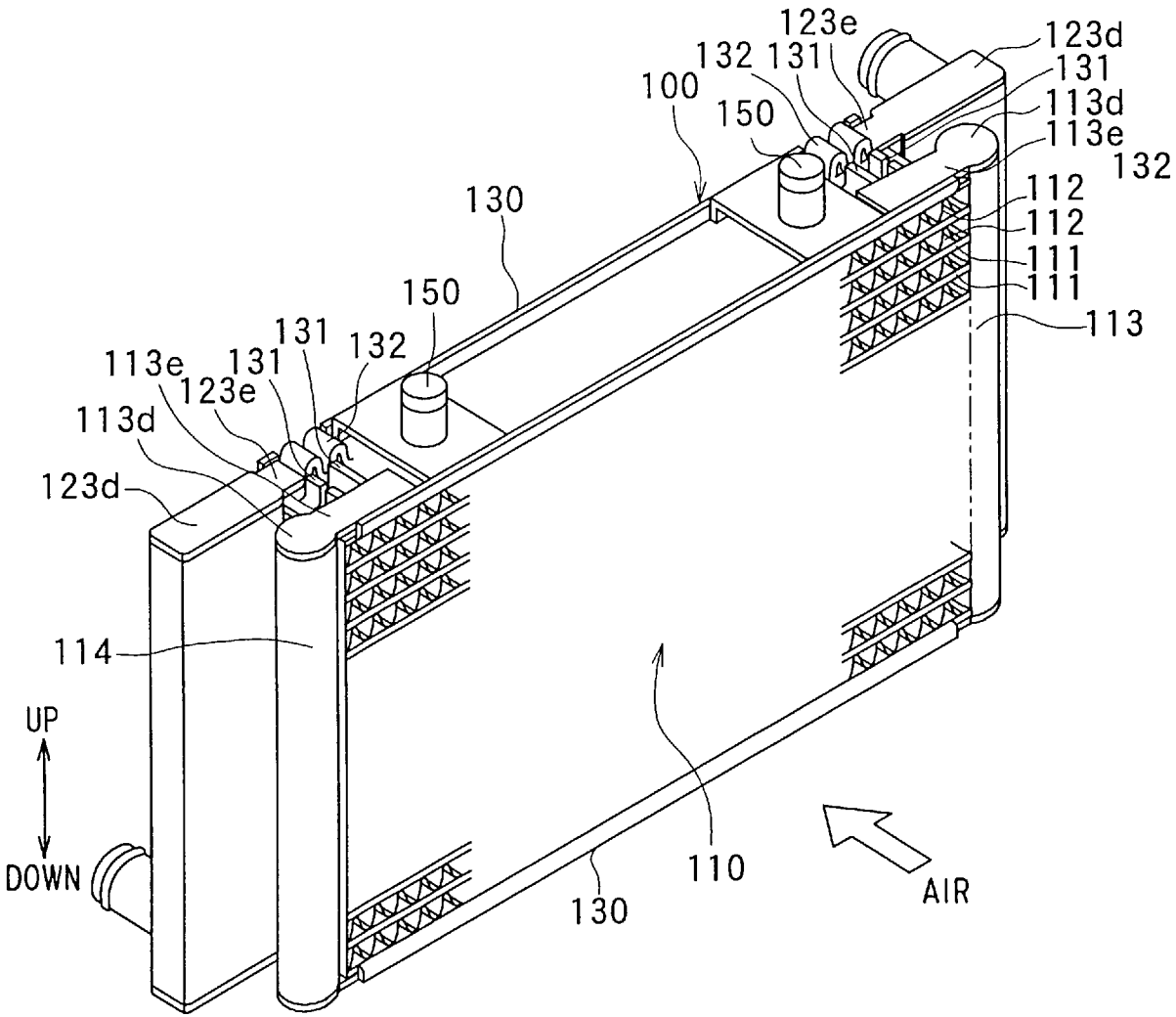
FIG. 1 is a perspective view of a double heat exchanger when being viewed from an upstream air side, according to a first preferred embodiment of the present invention.

Preferred embodiments of the present invention will be described hereinafter with reference to the accompanying drawings.

A first preferred embodiment of the present invention will be now described with reference to FIGS. 1–8B. In the first embodiment, the present invention is typically applied to a double heat exchanger 100 in which a condenser 110 of a vehicle refrigerant cycle and a radiator 120 for cooling engine-cooling water are integrated. The condenser 110 is disposed at an upstream air side of the radiator 120, as shown in FIGS. 1 and 2.

Refrigerant circulating in the refrigerant cycle is heat-exchanged with air in the condenser 110 to be cooled. The condenser 110 includes plural condenser tubes 111 (first tubes) made of an aluminum material, plural condenser fins 112 (first fins) each of which is made of an aluminum material and is disposed between adjacent condenser tubes 111 to facilitate a heat exchange between refrigerant and air, and condenser header tanks 113, 114 (first header tank) which are made of an aluminum material and are disposed at both longitudinal ends of each condenser tube 111 to communicate with the condenser tubes 111. A condenser core is constructed by the plural condenser tubes 111 and the plural condenser fins 112.

Figure 2:
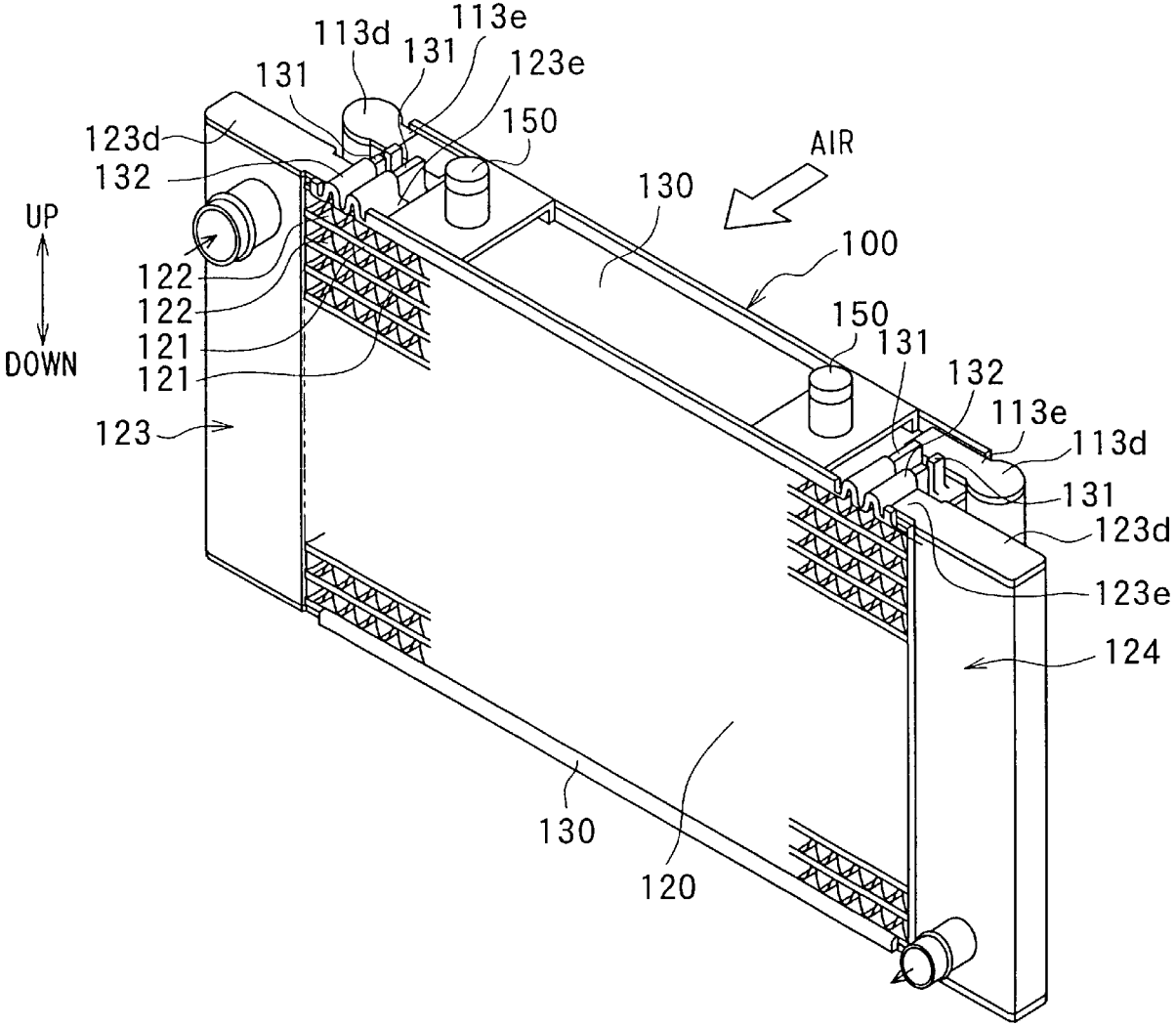
FIG. 2 is a perspective view of the double heat exchanger when being viewed from a downstream air side, according to the first embodiment.

The condenser header tank 113 disposed at a right side in FIG. 1 is for supplying refrigerant into the plural condenser tubes 111, and the condenser header tank 114 disposed at a left side in FIG. 1 is for collecting and receiving refrigerant having been heat-exchanged in the condenser tubes 111.

Figure 3:
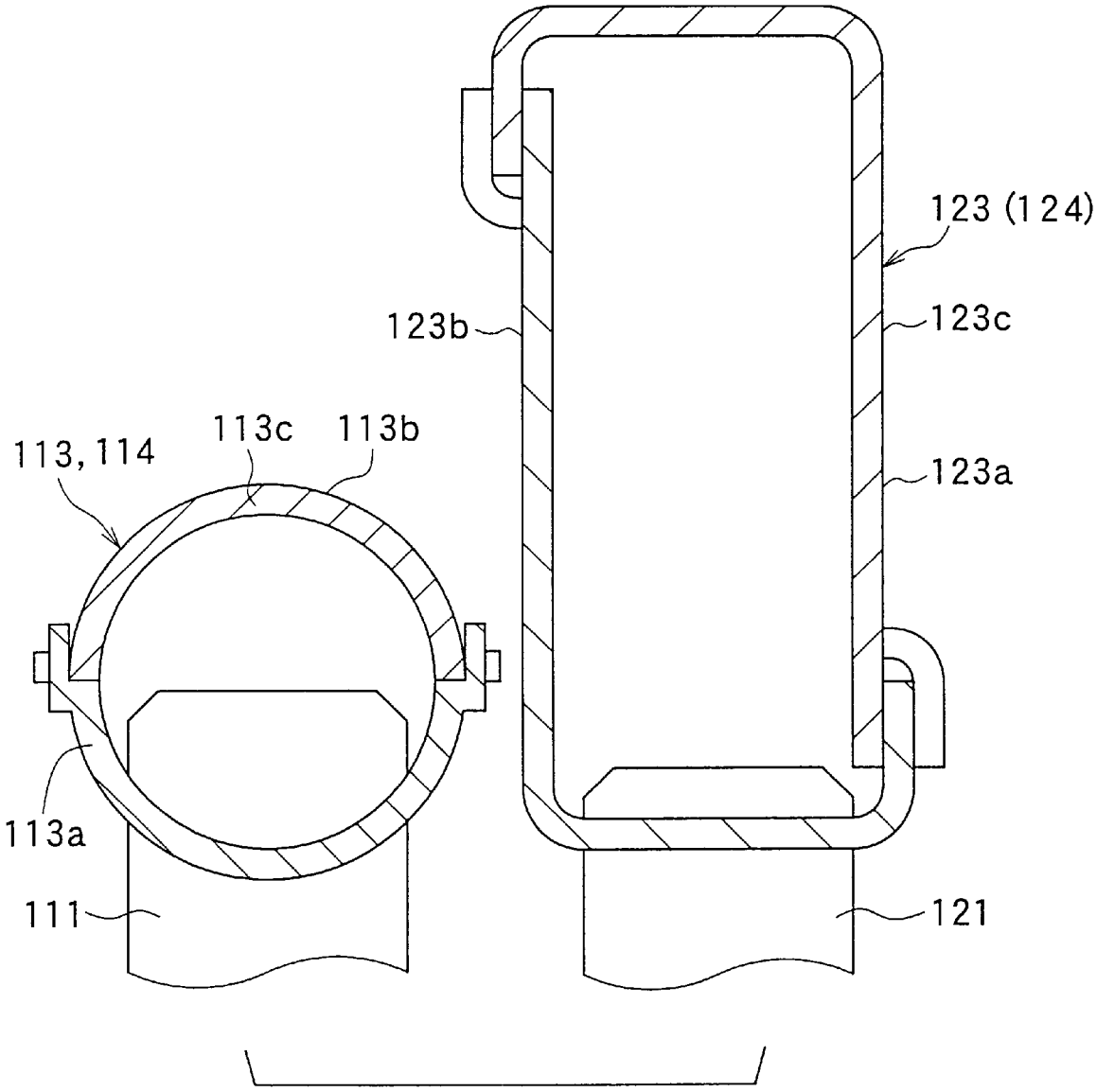
FIG. 3 is a sectional view showing header tanks of the double heat exchanger according to the first embodiment.

As shown in FIG. 3, at least one of the condenser header tanks 113, 114 includes a core plate 113*a* connected to the condenser tubes 111, and a plate cover 113*c*. The core plate 113*a* and the plate cover 113*c* are connected to construct a condenser header tank body 113*b* defining a cylindrical tank refrigerant passage through which refrigerant flows. The condenser header tank body 113*b* extends in a direction perpendicular to the longitudinal direction of the condenser tubes 111. Both ends of the condenser header tank body 113*b* in a longitudinal direction of the condenser header tank body 113*b* are closed by condenser header tank caps 113*d* as shown in FIG. 1.

Figure 4:
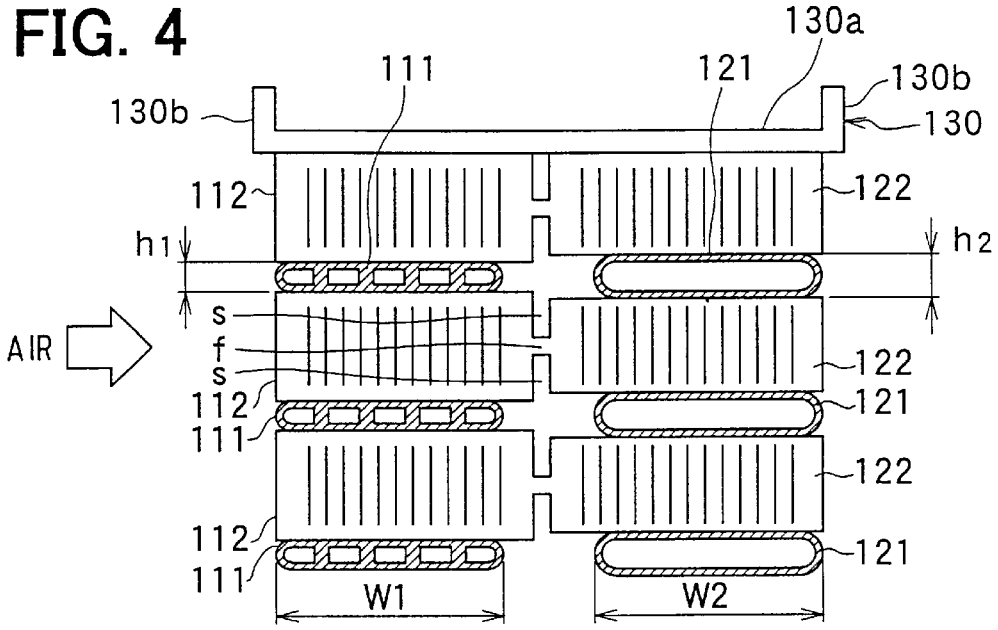
FIG. 4 is a schematic sectional view of the double heat exchanger according to the first embodiment.

Each condenser tube 111, having therein plural refrigerant passages as shown in FIG. 4, is formed into a flat shape by extrusion or drawing. As shown in FIG. 4, the condenser fins 112 are integrated with radiator fins. 122 described later.

On the other hand, in the radiator 120 shown in FIG. 2, cooling water from a vehicle engine is heat-exchanged with air to be cooled. The radiator 120 includes plural radiator tubes 121 (second tubes) made of an aluminum material, the plural radiator fins 122 (second fins) each of which is made of an aluminum material and is disposed between adjacent radiator tubes 121 to facilitate a heat exchange between cooling water and air, and radiator header tanks 123, 124 (second header tank) which are made of an aluminum material and are disposed at both ends of each radiator tube 121 to communicate with the radiator tubes 121. A radiator core is constructed by the plural radiator tubes 121 and the plural radiator fins 122.

The radiator header tank 123 disposed at a left side in FIG. 2 is for supplying and distributing cooling water into the plural radiator tubes 121, and the radiator header tank 124 disposed at a right side in FIG. 2 is for collecting and receiving cooling water having been heat-exchanged with air in the radiator tubes 121. As shown in FIG. 3, at least one of the radiator header tanks 123, 124 includes a radiator header tank body 123*c* extending in a direction perpendicular to a longitudinal direction of the radiator tubes 121, and a radiator tank caps 123*d* (see FIG. 2) for closing both longitudinal ends of the radiator header tank body 123*c*. The radiator header tank body 123*c* is composed of both radiator tank plates each of which has a L-shaped cross-section.

In the first embodiment, each of the radiator tubes 121 is formed into a simple flat shape as shown in FIG. 4. A minor-diameter dimension (i.e., thickness) h2 of each radiator tube 121 is made larger than a minor-diameter dimension (i.e., thickness) h1 of each condenser tube 111. Further, a major-diameter dimension W1 (i.e., width) of each condenser tube 111 is approximately equal to a major-diameter dimension W2 (i.e., width) of each radiator tube 121. In the double heat exchanger 100, a flow direction of air passing through the condenser 110 and the radiator 120 is in the major diameter direction of the tubes 111, 121.

Refrigerant flows through the condenser tubes 111 while a phase change from gas phase refrigerant to liquid phase refrigerant is generated. On the other hand, cooling water for cooling the vehicle engine flows through the radiator tubes 121 without a phase change. Therefore, in the first embodiment of the present invention, each sectional passage area of the radiator tubes 121 is set larger than that of the condenser tubes 111.

Both side plates 130 for reinforcing the condenser core and the radiator core are disposed at both ends of the condenser core and the radiator core to contact the condenser fins 112 at both ends and the radiator fins 122 at both ends. Each side plate 130 is formed into a U-shaped cross section (i.e., one-side opened square-box shape) to be opened to a side opposite to the fins 112, 122. That is, each side plate 130 has a bottom wall portion 130*a* connected to the fins 112, 122, and side wall plates 130*b* protruding from the bottom wall portion 130*a*, as shown in FIG. 4.

In the first embodiment, the tubes 111, 121, the fins 112, 122, the header tanks 113, 114, 123, 124 and the side plates 130 are integrally bonded by a brazing method (NB method) using a brazing material coated on the surfaces thereof. In this brazing method (NB method), after a flux for removing an oxidation coating is applied to an aluminum member coated with a brazing material, the aluminum member is heat-brazed under an inert gas such as nitrogen.

Figure 5:
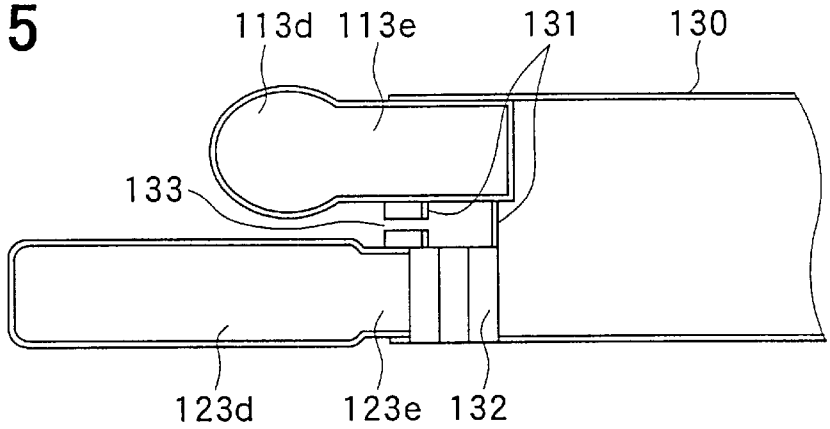
FIG. 5 is an upper side view showing connection portions between a side plate and the header tanks of the double heat exchanger according to the first embodiment.

As shown in FIGS. 1, 2 and 5, connection portions 113*e*, 123*e* extending toward a longitudinal end of the side plate 130 are provided in both the tank caps 113*d*, 123*d*, respectively. The connection portions 113*e*, 123*e* are bonded to the side plate 130 by brazing at connection portions of the side plate 130, so that both the tank caps 113*d*, 123*d* are integrated with the side plate 130.

Figure 6:
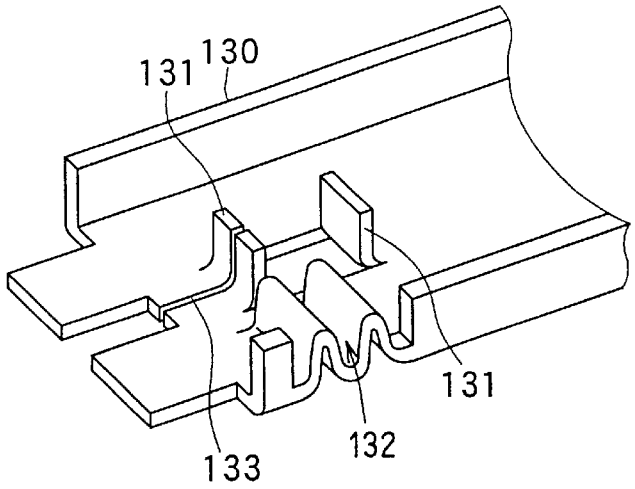
FIG. 6 is a perspective view showing a flexible portion of the side plate of the double heat exchanger, according to the first embodiment.
Figure 7:
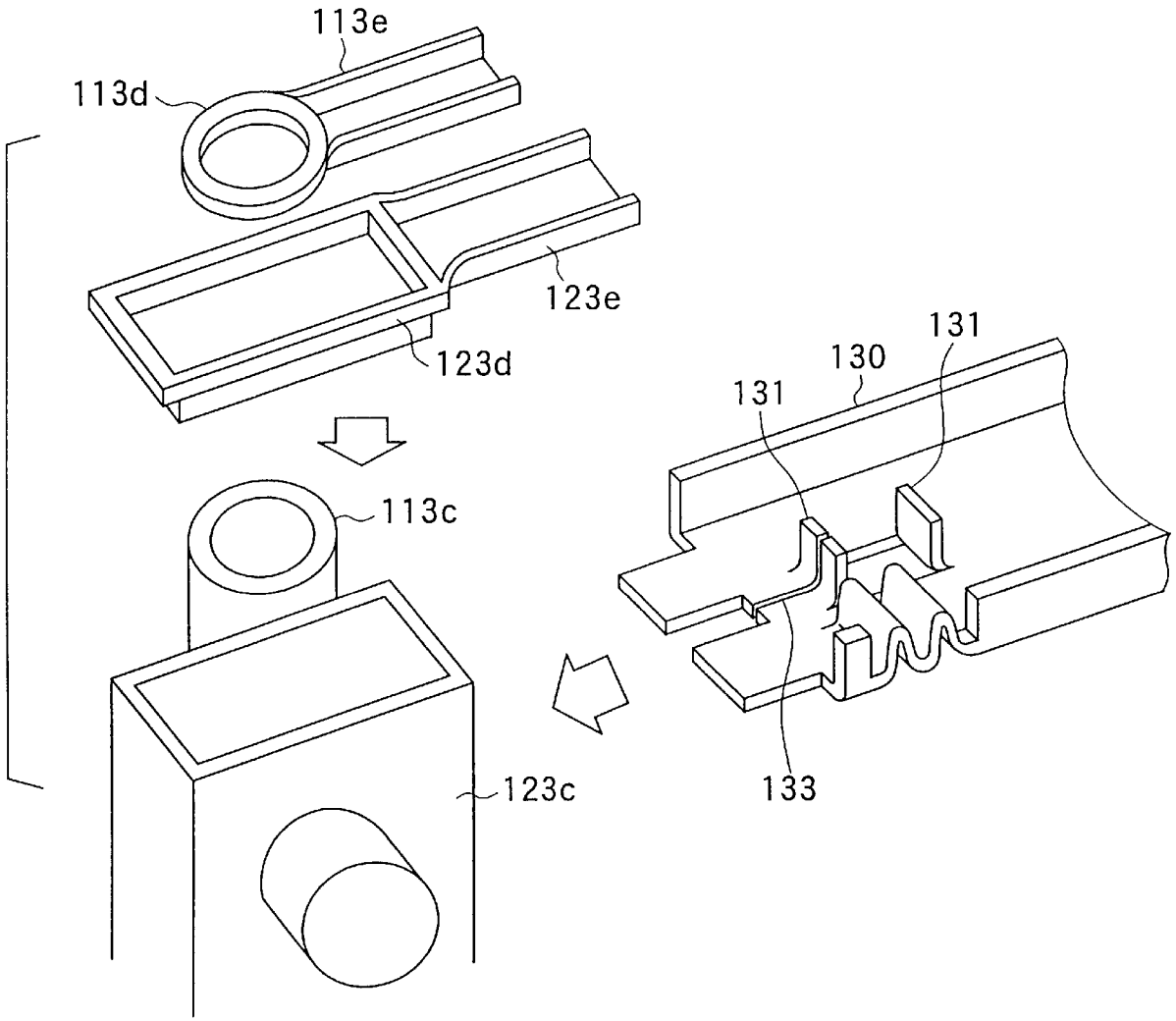
FIG. 7 is a view for explaining an assembling of a tank cap, a header tank and the side plate, according to the first embodiment.

Further, as shown in FIG. 6, protrusions 131 are integrally formed with both end portions of the side plate 130 in the longitudinal direction, at positions around the connection portions of the side plate 130. In the first embodiment of the present invention, each of the protrusions 131 is formed by cutting and bending a part of the bottom wall portion 130*a* of the side plate 130. The connection portions 113*e*, 123*e* of both the tank caps 113*d*, 123*d* are inserted between the protrusions 131 and the side wall portion 130*b* of the side plate 130, to be connected to the side plate 130 at predetermined connection positions.

At the connection portions (e.g., four positions) of the side plates 130 connected to the radiator header tanks 123, 124, a part of the side plate 130 is bent in a wave shape to form a flexible portion 132 having a spring characteristic (elastic performance), and a slit (recess) 133 extending from the longitudinal end of the side plate 130 to the flexible portion 132 is provided. The slit 133 is provided in the side plate 130 to separate the bottom wall portion 130*a* to both sides of the radiator 120 and the condenser 110, as shown in FIG. 6. In the first embodiment, the flexible portion 132 and the slit 133 are formed in pressing while the side plate 130 is formed.

According to the first embodiment of the present invention, the flexible portion 132 and the slit 133 are provided in the side plate 130 at the sides of the connection portions at which the radiator header tanks 123, 124 are connected to the side plates 130. Accordingly, even when a heat expansion amount of the radiator tubes 121 is different from that of the condenser tubes 111, because the flexible portion 132 is deformed in accordance with the difference of the heat expansion amount, heat stress generated in both the tubes 111, 121 can be effectively absorbed.

In addition, the slit 133 is provided in the side plate 130 to extend from each longitudinal end of the side plate 130 to a position where the flexible portion 132 is provided, in the longitudinal direction of the side plate 130.

Therefore, heat stress generated in both the tubes 111, 121 can be sufficiently absorbed by the flexible portion 132. In the first embodiment, it is unnecessary to elongate the slit 133 more than the flexible portion 133. Accordingly, in the first embodiment, it can prevent the strength of the side plate 130 from being decreased, while the heat stress generated in the tubes 111, 121 can be effectively reduced.

In the double heat exchanger with the condenser 110 and the radiator 120, because the temperature of cooling water in the radiator 120 is higher than that of refrigerant, contraction heat stress is generated in the radiator tubes 121, and expansion heat stress is generated in the condenser tubes 111.

Figure 8A:
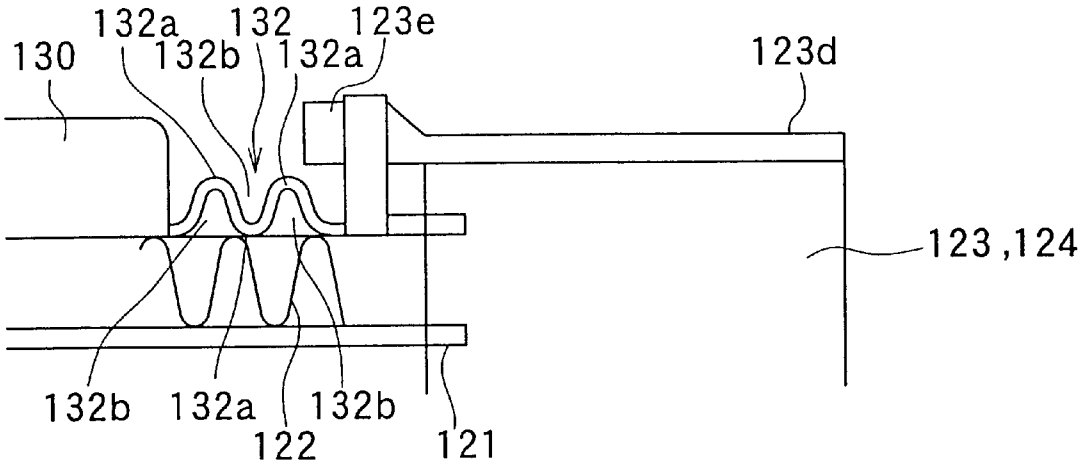
FIG. 8A is a front view showing the flexible portion of the double heat exchanger.
Figure 8B:
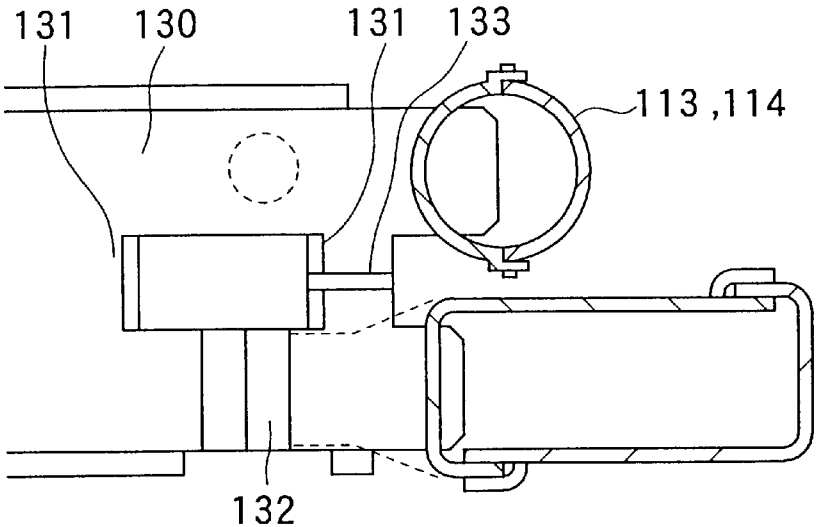
FIG. 8B is a top view of the flexible portion, according to the first embodiment.

In the first embodiment, as shown in FIG. 8A, because the flexible portion 132 is formed by bending a part of the side plate 130 in the wave shape having plural bent top portions 132*a* and plural bent portions 132*b*, the stress generated in the flexible portion 132 (bent top portions 132) can be readily expanded and contracted. That is, stress generated in the flexible portion 132 can be divided to the plural bent portions 132*b*. Therefore, in the first embodiment, it can prevent the strength of the side plate 130 from being greatly reduced due to the flexible portion 132.

In the double heat exchanger, generally, the temperature of cooling water flowing through the radiator 120 is approximately equal to or higher than 80° C., and the temperature of refrigerant flowing through the condenser 110 is approximately equal to or higher than 60° C. However, the tubes 111, 121 are manufactured in a room temperature (at least lower than 60° C.). Therefore, when the double heat exchanger 100 is used, the tubes 111, 121 are expanded as compared with the manufacturing state thereof.

Accordingly, when the double heat exchanger 100 is used, the heat expansion amount of the radiator tube 122 becomes larger than that of the condenser tube 111. In the first embodiment of the present invention, because the flexible portion 132 is provided in the side plates 130 at the sides of the connection portions between the side plate 130 and the radiator header tanks 123, 124, the heat stress generated in both the tubes 111, 121 can be effectively absorbed.

Figure 9:
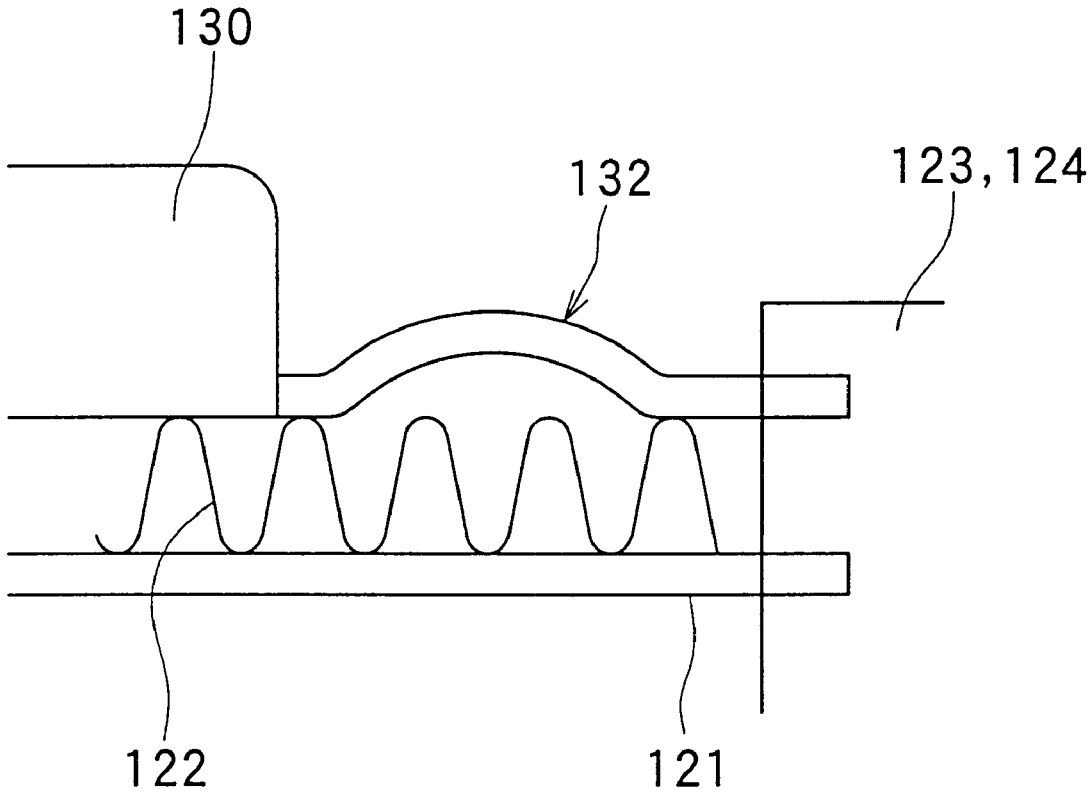
FIG. 9 is a front view showing a flexible portion of a double heat exchanger, according to a second preferred embodiment of the present invention.

A second preferred embodiment of the present invention will be now described with reference to FIG. 9. As shown in FIG. 9, in the second embodiment, a part of a side plate 130 is bent in a circular arc shape (dome shape) to form a flexible portions 132. Here, a curvature radius of the flexible portion 132 is made longer than a predetermined dimension, so that the stress generated in the flexible portion 132 can be made smaller, and it can prevent the strength of the side plate 130 from being reduced.

In the second embodiment, the other parts in the double heat exchanger are similar to those of the above-described first embodiment.

Figure 10A:
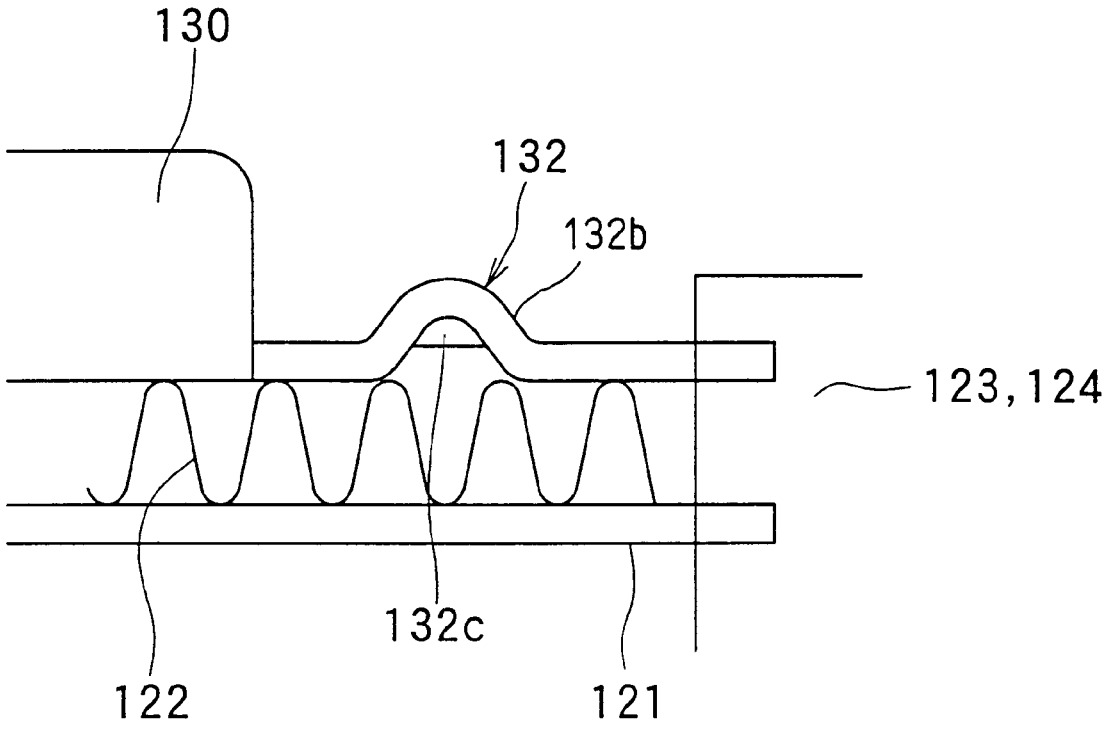
FIG. 10A is a front view showing a flexible portion of a double heat exchanger.
Figure 10B:
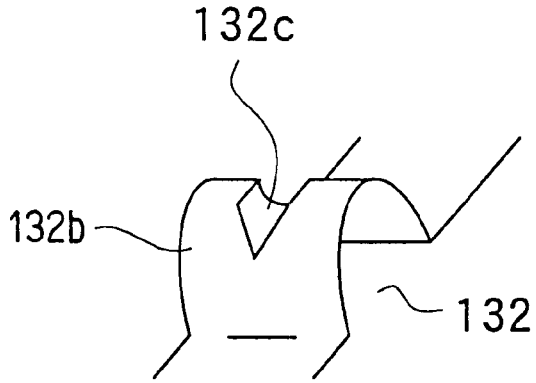
FIG. 10B is a perspective view showing the flexible portion, according to a third preferred embodiment of the present invention.

A third preferred embodiment of the present invention will be now described with reference to FIGS. 10A and 10B. In the third embodiment, as shown in FIGS. 10A and 10B, a flexible portion 132 is constructed by a bent portion 132*b*, and a recess portion recessed toward a curvature radial center is provided at a top portion of the bent portion 132*b* to form a reinforcement portion 132*c*. By providing the reinforcement portion 132*c*, a bending strength of the bent portion 132*b* of the flexible portion 132 can be increased.

In the third embodiment, the reinforcement portion 132*c* is provided in the flexible portion 132, so that the bending strength of the bent portion 132*b* can be increased in a range where the heat stress generated in the tubes 111, 121 can be absorbed by the flexible portion 132.

Figure 11A:
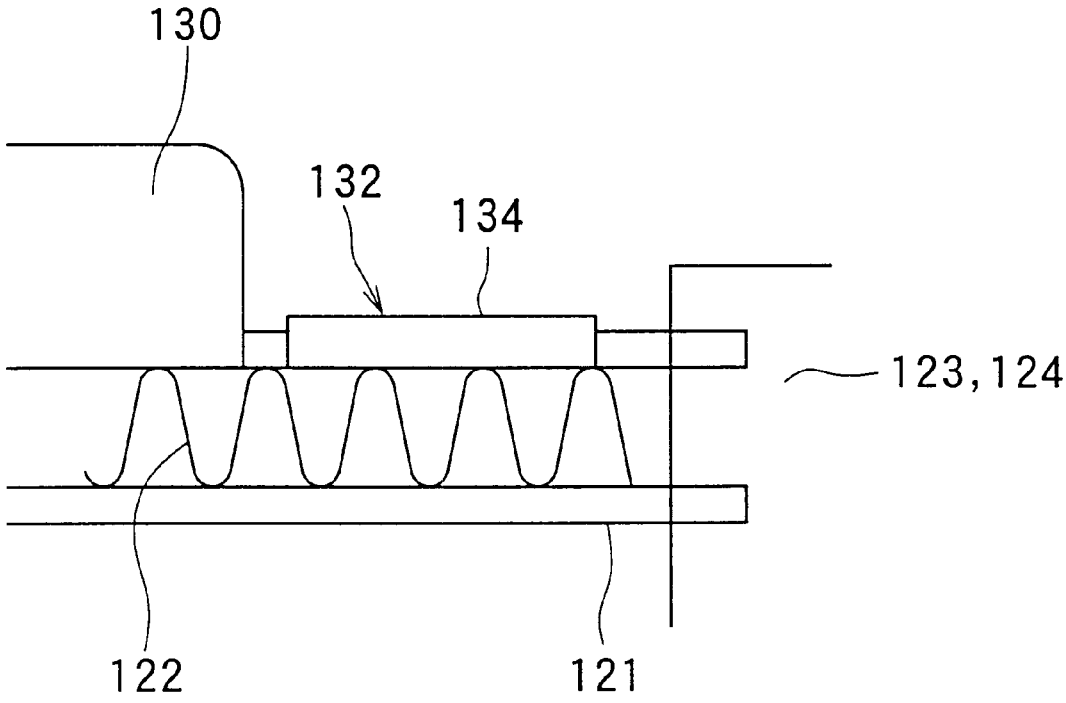
FIG. 11A is a front view showing a flexible portion of a double heat exchanger.
Figure 11B:
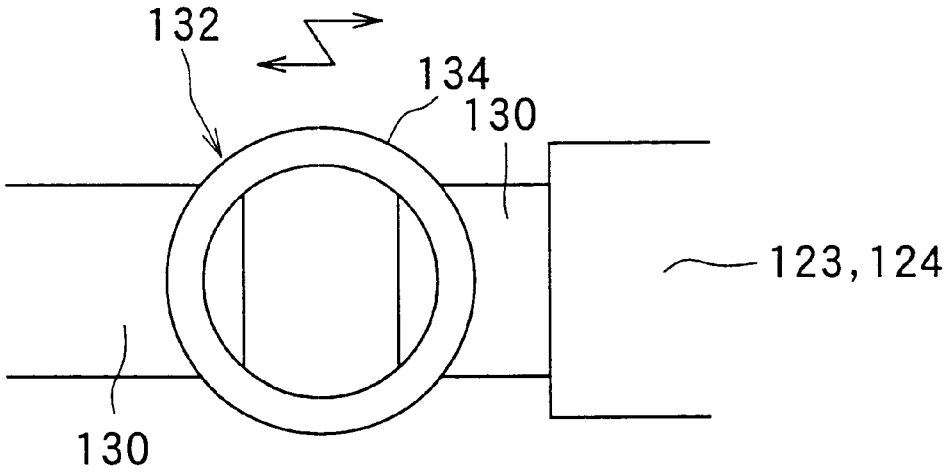
FIG. 11B is a top view showing the flexible portion, according to a fourth preferred embodiment of the present invention.

A fourth preferred embodiment of the present invention will be now described with reference to FIGS. 11A and 11B. In the fourth embodiment, as shown in FIGS. 11A and 11B, a link like flexible member 134 is formed separately from a side plate 130, and is bonded to the side plate 130 by brazing, so that a flexible portion 132 is constructed.

In the fourth embodiment, the side plate 130 is separated into two parts at a side of the connection portions, and both the separated parts of the side plate 130 are connected through the flexible member 134. Among the separated two parts of the side plate 130, one part is disposed to be connected to the radiator header tank 123, 124 at a side of the connection portions.

In the fourth embodiment, the flexible member 134 is formed into the link shape. However, the flexible member 134 can be formed into the other shape such as a wave shape, a square shape and an elliptical shape. Even in this case, the advance described in the first embodiment can be obtained.

Figure 12A:
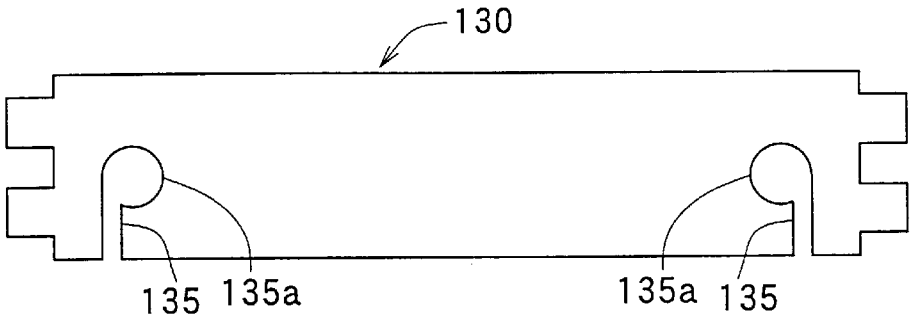
FIG. 12A is a front view showing a side plate of a double heat exchanger.
Figure 12B:
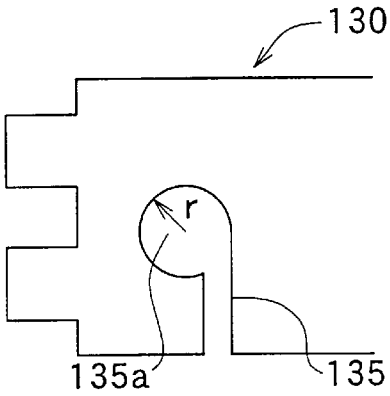
FIG. 12B is an enlarged view showing a slit provided in the side plate, according to a fifth preferred embodiment of the present invention.

A fifth preferred embodiment of the present invention will be now described with reference to FIGS. 12A–13B. In the fifth embodiment, as shown in FIGS. 12A and 12B, both slits 135 (recess portions) each of which extends in a direction crossing with the longitudinal direction of a side plate 130 are provided at both sides of the longitudinal ends of the side plate 130. In the example shown in FIGS. 12A and 12B, each of the slits 135 extends in a direction perpendicular to the longitudinal direction of the side plate 130, and has a slit end portion 135*a* (R portion) formed into a substantial round shape at the top end side of the slit 135. The slit end portion 135*a* is curved to have a curvature radius equal to or larger than a predetermined dimension. Because the slits 135 are provided in the side plate 130 at both the longitudinal end sides of the side plate 130, the heat stress generated in the tubes 111, 121 can be absorbed by the change of an opening area of the slits 135, even when a difference is caused between the heat expansion amount of the radiator tubes 121 and the heat expansion amount of the condenser tubes 111.

Further, because the expanded slit end 135*a* having the curvature radius r larger than the predetermined dimension is provided, it can prevent the stress from being collected to the end portion of the slit 135. Accordingly, it can prevent a crack from being caused at the end portion of the slit 135. Thus, the heat stress generated in the tubes 111, 121 can be absorbed, while durability of the side plate 130 can be improved.

When the curvature radius r of the slit end portion 135*a* is excessively small, it is difficult to sufficiently remove a collection of the stress. Therefore, preferably, the curvature radius r of the slit end portion 135*a* is made equal to or larger than the thickness of the side plate 130.

Figure 13A:
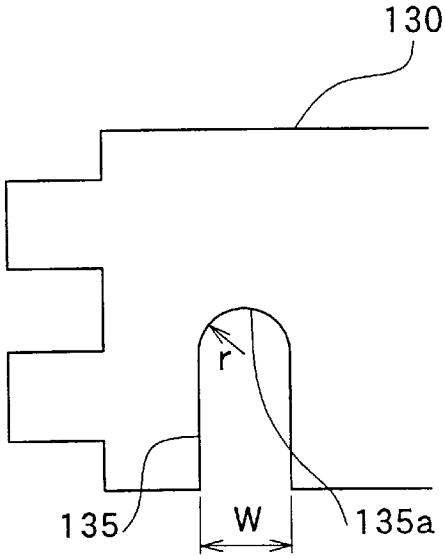
FIGS. 13A and 13B are enlarged views each showing a slit provided in the side plate, according to the fifth embodiment.
Figure 13B:
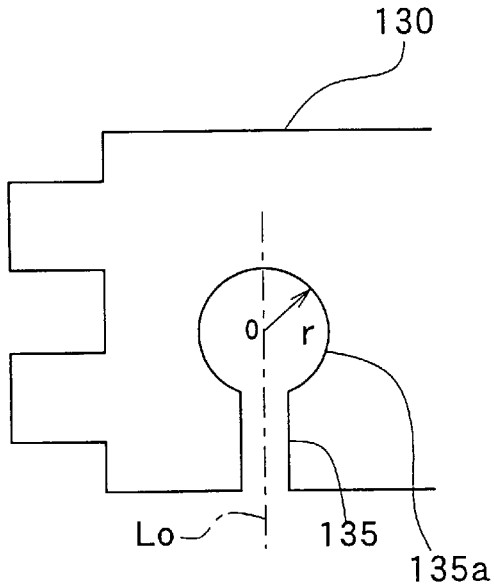

The shape of the slit end portion 135*a* (R portion) can be changed as shown in FIGS. 13A and 13B, for example. That is, as shown in FIG. 13A, a width dimension W of the slit 135 can be made approximately double of the curvature radius r of the slit end portion 135*a*. Further, as shown in FIG. 13B, the slit 135 can be formed into a key shape where a curvature center "o" of the slit end 135*a* is positioned on a center line Lo of the slit 135.

Although the present invention has been fully described in connection with the preferred embodiments thereof with reference to the accompanying drawings, it is to be noted that various changes and modifications will become apparent to those skilled in the art.

For example, in the above-described embodiments, at least one flexible portion 132 can be provided at one side of the connection portions, among the connection portions (four points) between both the side plates 130 and the radiator header tanks 123, 124, and the connection portions (four points) of both the side plates 130 and the condenser header tanks 113, 114. That is, the flexible portion 132 can be provided at least for one connection portion between both the side plates 130 and the header tanks 113, 114, 123, 124.

In the above-described embodiments, both the tank caps 113*d*, 123*d* are integrated with the side plate 130 by brazing. However, both the tank caps 113*d*, 123*d* can be provided separately from the side plates 130.

Such changes and modifications are to be understood as being within the scope of the present invention as defined by the appended claims.

What is claimed is:

1. A double heat exchanger comprising:

a first core for performing heat exchange between a first fluid and air, the first core having a plurality of first tubes through which the first fluid flows;

both first header tanks disposed at both longitudinal ends of each first tube to communicate with the first tubes;

a second core for performing heat exchange between a second fluid and air, the second core having a plurality of second tubes through which the second fluid having a temperature higher than that of the first fluid flows, and being arranged in a line in an air-flowing direction with the first core;

both second header tanks disposed at both longitudinal ends of each second tube to communicate with the second tubes; and a side plate disposed at one side of the first and second cores to extend in a direction parallel with the first and second tubes, for reinforcing the first and second cores, wherein:

the side plate is disposed to be connected to both the first header tanks and both the second header tanks at connection portions;

the side plate has a recess portion extending from one end in a direction crossing with the longitudinal direction of the side plate at least at one side of the connection portions; and the recess portion has a recess top part curved by a curvature radius larger than a predetermined dimension.

2. The double heat exchanger according to claim 1, wherein the curvature radius is equal to or larger than a thickness of the side plate.

3. The double heat exchanger according to claim 1, wherein the recess portion is recessed from one end of the side plate in a direction width perpendicular to the longitudinal direction of the side plate to extend substantially in the width direction.

4. A double heat exchanger comprising:

a first core for performing heat exchange between a first fluid and air, the first core having a plurality of first tubes through which the first fluid flows;

both first header tanks disposed at both longitudinal ends of each first tube to communicate with the first tubes;

a second core for performing heat exchange between a second fluid and air, the second core having a plurality of second tubes through which the second fluid having a temperature higher than that of the first fluid flows, and being arranged in a line in an air-flowing direction with the first core;

both second header tanks disposed at both longitudinal ends of each second tube to communicate with the second tubes; and a side plate disposed at one side of the first and second cores to extend in a direction parallel with the first and second tubes, for reinforcing the first and second cores, wherein:

the side plate is disposed to be connected to both the first header tanks and both the second header tanks at connection portions; and the side plate has a flexible portion disposed to be flexible at only one side of the connection portions, and a recess extending from one longitudinal end of the side plate until the flexible portion in a longitudinal direction of the side plate to separate the side plate at the one side of the connection portions.

5. The double heat exchanger according to claim 4, wherein:

the flexible portion has a wave shape having a plurality of bent portions, and is provided by bending a part of the side plate.

6. The double heat exchanger according to claim 4, wherein:

the flexible portion is provided by bending a part of the side plate to have a bent portion; and the flexible portion has a reinforcement portion provided in the bent portion for increasing a bending strength of the bent portion.

7. The double heat exchanger according to claim 4, wherein:

the flexible portion includes a flexible member formed separately from the side plate; and the flexible portion is constructed by bonding the flexible member to the side plate.

8. The double heat exchanger according to claim 4, wherein the flexible portion is provided in the side plate adjacent to one connection portion.

* * * * *